United States Patent [19]

Friedrich et al.

[11] Patent Number: 4,752,195

[45] Date of Patent: Jun. 21, 1988

[54] ROTARY VANE TYPE OF PUMP WITH ELONGATED DAMPING CHAMBERS

[75] Inventors: Peter Friedrich; Johann Merz, both of Schwäbisch Gmünd, Fed. Rep. of Germany

[73] Assignee: Zahnradfabrik Friedrichshafen, AG., Friedrichshafen, Fed. Rep. of Germany

[21] Appl. No.: 912,601

[22] PCT Filed: Dec. 3, 1985

[86] PCT No.: PCT/EP85/00663

§ 371 Date: Aug. 7, 1986

§ 102(e) Date: Aug. 7, 1986

[87] PCT Pub. No.: WO86/04393

PCT Pub. Date: Jul. 31, 1986

[30] Foreign Application Priority Data

Jan. 15, 1985 [EP] European Pat. Off. ..... PCT/EP85/00010

[51] Int. Cl.[4] ..... F04B 11/00; F04C 2/344; F04C 15/00

[52] U.S. Cl. ..... 417/540; 418/133; 418/181; 418/259

[58] Field of Search ..... 418/78, 82, 133, 181, 418/259, 270, 75; 417/540

[56] References Cited

U.S. PATENT DOCUMENTS

| | | | |
|---|---|---|---|
| 2,357,334 | 9/1944 | Kendrick et al. | 418/82 |
| 2,762,312 | 9/1956 | Adams et al. . | |
| 2,855,857 | 10/1958 | Sung . | |
| 3,007,419 | 11/1961 | Burt . | |
| 3,145,662 | 8/1964 | Eickmann . | |
| 3,233,552 | 2/1966 | Kinnavy . | |
| 3,311,064 | 3/1967 | Eichele et al. | 418/133 |
| 4,068,987 | 1/1978 | Crooks | 418/181 |
| 4,416,598 | 11/1983 | Merz | 418/133 |

FOREIGN PATENT DOCUMENTS

| | | | |
|---|---|---|---|
| 1298807 | 9/1969 | Fed. Rep. of Germany . | |
| 1576941 | 5/1973 | Fed. Rep. of Germany . | |
| 950954 | 8/1982 | U.S.S.R. | 417/540 |

*Primary Examiner*—John J. Vrablik
*Attorney, Agent, or Firm*—Zalkind & Shuster

[57] ABSTRACT

A vane type pump has an elongated pump housing through which the drive shaft of the pump passes. The usual components of the pump comprising a rotor which carries vanes within a cam ring is disposed between an inner end wall of the housing and a pressure plate wherein the pressure plate has pressure recesses or pockets. Damping chambers are provided in the elongated housing generally parallel to the drive shaft and substantially co-extensive with the housing bore that carries the drive shaft. Thus, very large volume damping chambers are provided for smoothing out pump pulsations in the course of operation.

8 Claims, 1 Drawing Sheet

ROTARY VANE TYPE OF PUMP WITH ELONGATED DAMPING CHAMBERS

BACKGROUND OF THE INVENTION

This invention relates to improvements in a vane pump of a type which is generally well known in the art.

Vane types of pumps are generally provided with a pump housing and a rotor disposed between a pressure plate and a housing body, with the rotor connected to a driving shaft. The rotor has radialy displacable vanes and a surrounding cam ring. Pressure chambers and suction chambers of the pump are formed in the region between the confronting wall surfaces of the housing body and the pressure plate from which pressurized fluid in the pressure chambers is conducted to an outlet in accordance with prior art arrangements as exemplified by the disclosures in U.S. Pat. Nos. 2,357,334, 3,311,064 and 4,416,598 to Kendrick, Eichele and Merz, respectively. Such vane type pumps may also have pressure equalizing passages for the pressure chambers between the pressure plate and front wall of the housing body. The pressure equalization passages were heretofore simple, flat grooves or channels in the front wall of the housing body or in the confronting wall of the pressure plate opposite its pressure side.

Vane type pumps of the foregoing type were prone to the development of noise especially under high speed conditions mainly because of pressure pulsations. For this reason, correspondingly large pressure chambers have been proposed in order to decrease or avoid high magnitude pressure pulsations. However, such corrective measure is inconsistent with the need to construct the pump as small as possible. Further, the pressurized spaces within the pump should be made as small as possible in order to minimize internal forces.

In regard to the latter size reduction measure, the pressure collection space on the pressure side of the pump has been correspondingly enlarged so that the pressure pulsations may be reduced. However, such enlargement of the pressure collecting space is disadvantageous since it involves a significant increase in the size of the pump construction. Furthermore, the degradation of the pressure pulsations thereby achieved, is rather limited.

Therefore, an important object of the present invention is to provide a vane cell pump of the aforementioned type that is less costly to manufacture and yet avoids or largely reduces the pressure pulsations with minimal increase in size of the pump construction.

SUMMARY OF THE INVENTION

According to the invention, pressure equalization openings formed as damping chambers extend from a front wall of the housing body rearwardly. Such pressure equalization openings additionally functionn to avoid pressure pulsations.

As a result of the rearward elongation of the pressure equalizing openings in accordance with the present invention, adequate damping chamber volume is provided to serve as buffers. Since the driving shaft is mounted in the housing and must have a corresponding constructional length, the damping spaces or chambers according to the invention require no special enlargement of the housing. Rather than utilizing the pressure collecting space for damping fully developed pulsations, the damping spaces according to the present invention have the advantage of preventing development of pressure pulsations so that it will be possible to avoid such pulsations more easily than by eliminating the pulsations after they are fully developed.

There is another advantage in providing a separate damping space for each pressure chamber of the pump in accordance with the present invention. Since the damping spaces for the two pressure chambers are not connected with one another in accordance with the present invention, they do not mutually influence each other so as to avoid transmission of any pulsations therebetween as in the case of prior art arrangements.

The damping spaces may extend in an axial direction through the housing body as a result of which they are produced in a simple manner, although other arrangements are possible within the purview of the present invention. In order to obtain an optimum utilization of the available space for the creation of damping chambers, the damping spaces extend in a generally axial direction through the housing between its front wall facing the rotor and cam ring and its opposite closing wall which has a center bore for the introduction of the driving shaft.

The center bore has a stepped bore portion in which a sealing ring for the drive shaft is disposed and the damping spaces extend in axially overlapping relation to the stepped bore portion. As a result of the foregoing arrangement, damping spaces of maximum volume are provided, taking into account the rear wall thickness of the housing. Simple and cheap production is thereby realized particularly when the housing body with the damping spaces therein is made of a light-metal pressure casting, although the use of other materials is possible within the scope of the invention.

Hereinafter, an embodiment of the invention is described by way of example with reference to the drawings.

BRIEF DESCRIPTION OF DRAWING FIGURES

DETAILED DESCRIPTION OF PREFERRED EMBODIMENT

Figure 1:
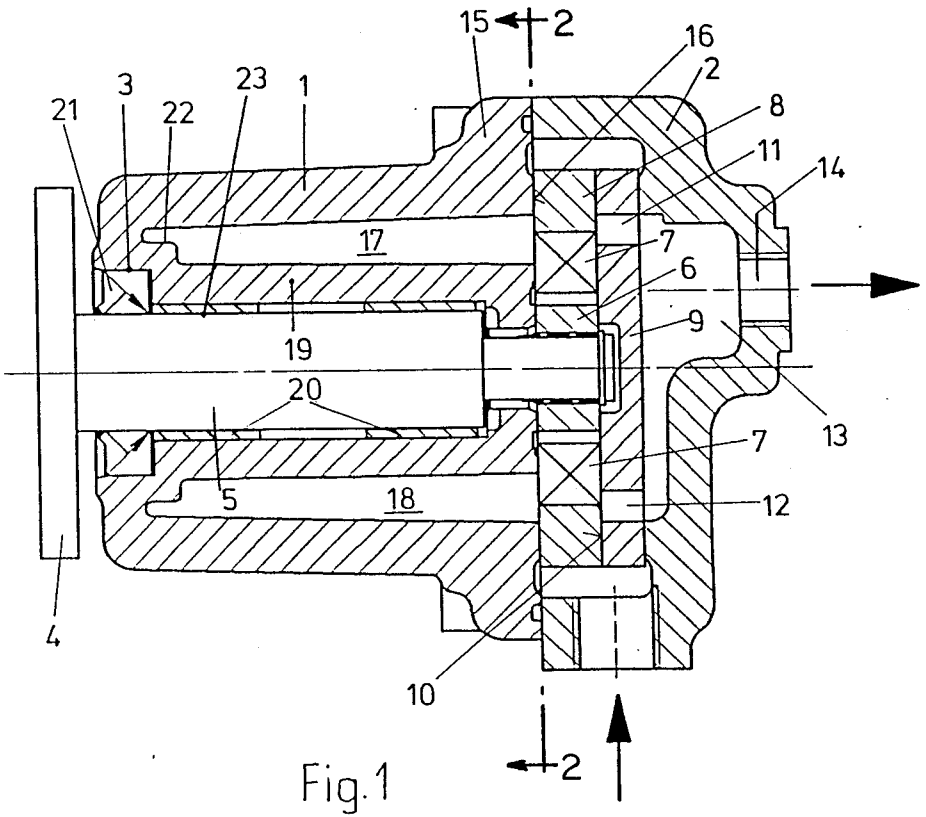
FIG. 1 is a longitudinal section view through a vane cell pump constructed in accordance with one embodiment of the present invention.

The invention relates to a vane cell pump which is basically of a known construction such as those disclosed in the Kendrick, Eichele and Merz patents aforementioned. The vane cell pump has a pump housing body 1 with a lid 2. In the housing body 1, there is a center bore 23 which is developed on the inlet side as a stepped bore portion 3. In the center bore 23, a driving shaft 5 is rotatably mounted and provided with a driving flange 4. At the front end of the driving shaft, there is a rotor 6 which is connected firmly with the driving shaft. The rotor 6 carries a plurality of radially displacable vanes 7 distributed over its periphery within slits in the customary manner well known in the art. The rotor is furthermore surrounded by a curved cam ring 8 having the usual shape as disclosed in the Kendrick, Eichele and Merz patents aforementioned. On the pressure side of the pump, that is to say on the side of the rotor facing the lid 2, there is a pressure plate 9 having its wall surface 10 forced against the rotor 6 and the curved cam ring 8. In the wall surface 10 are the usual control grooves and pressure pockets 11 and 12 in communication with a pressure collecting space 13. Through the pressure space 13, the pressure medium flow from inside the pump to an outlet opening 14.

On the side of the cam ring 8 opposite the pressure plate 9, the housing body 1 has a flanged portion 15 with a front wall surface 16. The front wall surface 16 constitutes the end of the usual pump pressure chambers and suction chambers.

Figure 2:
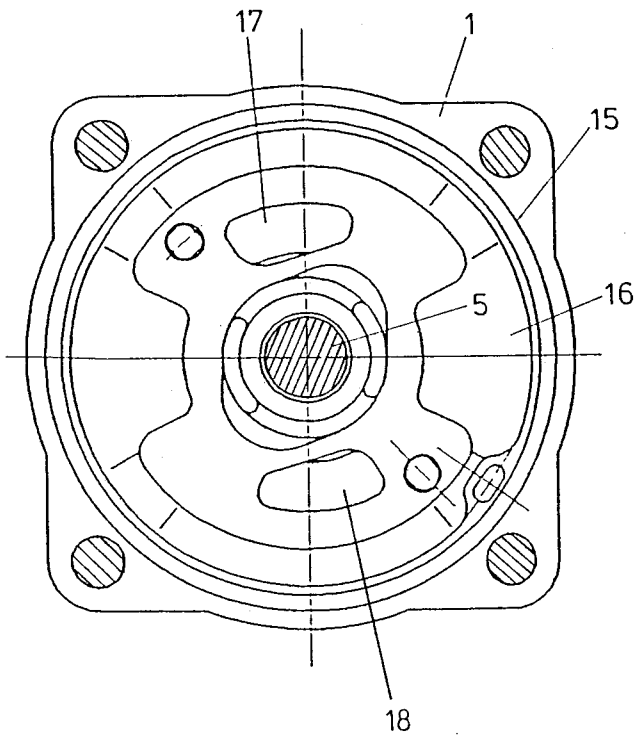
FIG. 2 is a transverse section view taken substantially through a plane indicated by section line 2—2 in FIG. 1.

As more clearly seen in FIG. 1, pressure equalizing openings extend rearwardly from the front wall surface 16 of the flanged portion 15 of the housing body 1 in such a manner that they form two damping chambers or spaces 17 and 18 within the housing body. The damping spaces are respectively aligned with the pressure pockets 11 and 12, as shown, so as to compensate for radial and axial forces as in most prior art vane pumps. The damping spaces 17 and 18 extend in parallel relation to the driving shaft 5 practically through the entire housing body 1. Viewed in cross section, the damping spaces 17 and 18 are formed in the shape of kidneys (see FIG. 2) for adaptation to the pressure chambers in the pressure plate 9 with which they communicate indirectly under control of the vanes 7 of the rotor 6 during its rotation.

As will be apparent, the damping spaces 17 and 18 extend about the bearing portion 19 of the housing body 1 within which slide bearings 20 are disposed for rotational support of the driving shaft 5. A shaft sealing ring 21 is disposed in the stepped bore portion 3 to perform the usual shaft sealing function.

So that the damping spaces 17 and 18 will be as large as possible while maintaining minimum wall thickness, the axial ends thereof remote from the curved cam ring 8 have shoulder formations 22 which axially overlap the stepped bore portion 3 as shown in FIG. 1. In this manner, an additional space is provided for damping purposes.

The particular housing body 1 and lid 2 have been selected arbitarily as the environment for the improvements of the present invention. It is however critical, that the damping spaces 17 and 18 be located in a vane cell pump within which the driving shaft is mounted. The housing body must have a predetermined length for mounting of the driving shaft. Such constructional length of the housing body according to the present invention, accomodates the formation of the damping spaces.

What is claimed is:

1. In a vane pump having an elongated housing (1) with a shaft bore (23) therethrough supporting therein a drive shaft (5) and vanes (7) carried by a rotor (6) on said drive shaft within a cam ring (8), said rotor, said vanes, and said cam ring being confined between a wall (16) of said housing and a pressure plate (9); said pressure plate having pressure pockets (11,12) communicating with a pump outlet (14); the improvement which comprises elongated damping means (17,18) extending into said housing from the housing wall axially opposite the pump outlet for fluid communication with the pressure pockets under control of the rotor to equalize pressure and dampen pressure pulsations otherwise developed in response to rotation of the rotor;

wherein the damping means includes a damping chamber for each of the pressure pockets.

2. In a vane pump as set forth in claim 1, wherein the damping chambers extend in axially parallel relation to the drive shaft within said elongated housing.

3. In a vane pump as set forth in claim 1, wherein said damping chambers are disposed on opposite sides of said shaft bore.

4. In a vane pump as set forth in claim 1, said damping chambers being disposed on opposite sides of said shaft bore, said elongated housing having an end wall opposite said first mentioned housing wall wherein said damping chambers extend substantially to said end wall, said shaft bore extending through said end wall.

5. In a vane pump as set forth in claim 1, wherein the damping chambers extend axially in said elongated housing, on opposite sides of said shaft bore, said elongated housing having an end wall opposite said first mentioned housing wall, said damping chambers extend substantially to said end wall, said shaft bore extending through said end wall.

6. In a vane pump as set forth in claim 1, each pressure chamber having a damping chamber, wherein the damping chambers extend axially in said elongated housing and are disposed on opposite sides of said shaft bore.

7. In a vane pump having an elongated housing (1) with a shaft bore (23) therethrough supporting therein a drive shaft (5) and vanes (7) carried by a rotor (6) on said drive shaft within a cam ring (8), said rotor, said vanes, and said cam ring being confined between a wall (16) of said housing and a pressure plate (9); said pressure plate having pressure pockets (11,12) communicating with a pump outlet (14); the improvement which comprises elongated damping means (17,18) extending into said housing from the housing wall axially opposite the pump outlet for fluid communication with the pressure pockets under control of the rotor to equalize pressure and dampen pressure pulsations otherwise developed in response to rotation of the rotor;

wherein said elongated housing has an end wall opposite said first mentioned housing wall; said damping means extending substantially to said end wall, said shaft bore extending through said end wall;

said end wall terminating in a counterbore (3) having a sealing ring (21) therein in engagement with said drive shaft; said damping means extending to said counterbore and having narrowing ledges (22) radially spacing said counterbore therefrom internally within said housing.

8. In a pump having a housing, a cam ring (8) in said housing 1, a rotor (6), said cam ring surrounding the rotor to effect a pumping action in response to rotation of the rotor, means (3,5,20,23) for rotatively mounted said rotor, sealing wall means (9,16) on opposite sides of said rotor and the cam ring within said housing for sealing thereof, first chamber means (13) spaced by one of said sealing wall means (9) from the rotor and the cam ring on one of the sides thereof for collecting fluid pressurized by said pumping action, second chamber means (17,18) on the other of said sides of the rotor and the cam ring for equalizing pressure and damping pulsations of the pressurized fluid collected within the first chamber means, said second chamber means having an end portion axially spaced from the other of the sealing wall means (16) and shoulder means (22) in said housing for radially spacing said end portion of the second chamber means from the rotor mounting means.

* * * * *